US011316255B2

(12) United States Patent
Zhou et al.

(10) Patent No.: US 11,316,255 B2
(45) Date of Patent: Apr. 26, 2022

(54) ANTENNA AND TERMINAL DEVICE

(71) Applicant: Honor Device Co., Ltd., Guangdong (CN)

(72) Inventors: Dawei Zhou, Beijing (CN); Shichao Li, Shenzhen (CN); Wanbo Xie, Shenzhen (CN); Hanyang Wang, Reading (GB)

(73) Assignee: HONOR DEVICE CO., LTD., Shenzhen (CN)

( * ) Notice: Subject to any disclaimer, the term of this patent is extended or adjusted under 35 U.S.C. 154(b) by 193 days.

(21) Appl. No.: 16/498,999

(22) PCT Filed: Mar. 29, 2017

(86) PCT No.: PCT/CN2017/078623
§ 371 (c)(1),
(2) Date: Sep. 27, 2019

(87) PCT Pub. No.: WO2018/176279
PCT Pub. Date: Oct. 4, 2018

(65) Prior Publication Data

US 2020/0052377 A1 Feb. 13, 2020

(51) Int. Cl.
*H01Q 1/24* (2006.01)
*H01Q 5/10* (2015.01)

(52) U.S. Cl.
CPC ..... *H01Q 1/243* (2013.01); *H01Q 5/10* (2015.01)

(58) Field of Classification Search
CPC H01Q 1/243; H01Q 1/44; H01Q 5/10; H01Q 5/328; H01Q 5/378
See application file for complete search history.

(56) References Cited

U.S. PATENT DOCUMENTS 9,413,058 B1 8/2016 Kuo et al.
2014/0266922 A1* 9/2014 Jin ..... H01Q 5/314 343/702
2014/0375515 A1 12/2014 Qiu et al.
2015/0002347 A1* 1/2015 Jeong ..... H01Q 5/321 343/722

(Continued)

FOREIGN PATENT DOCUMENTS

CN 103633426 A 3/2014
CN 104064865 A 9/2014

(Continued)

OTHER PUBLICATIONS

Machine Translation and Abstract of Chinese Publication No. CN105305067, Feb. 3, 2016, 11 pages.

(Continued)

*Primary Examiner* — Awat M Salih
(74) *Attorney, Agent, or Firm* — Conley Rose, P.C.

(57) ABSTRACT

An antenna comprising a metal frame and at least one resonating structure. The metal frame includes a first radiating element and a second radiating element. The first radiating element includes a radiation arm coupled to a feedpoint. The second radiating element includes a suspended radiation arm. Each resonating structure includes a suspended radiation arm and a resonating component, and the suspended radiation arm is coupled to a ground point by using the resonating component.

20 Claims, 13 Drawing Sheets

(56) References Cited

U.S. PATENT DOCUMENTS

| | | | | |
|---|---|---|---|---|
| 2015/0171916 | A1* | 6/2015 | Asrani | H04M 1/0202 455/575.7 |
| 2015/0222020 | A1 | 8/2015 | Tai et al. | |
| 2015/0318601 | A1 | 11/2015 | Lin | |
| 2016/0013543 | A1 | 1/2016 | Nguyen | |
| 2016/0211570 | A1 | 7/2016 | Jin et al. | |
| 2016/0285153 | A1 | 9/2016 | Li et al. | |
| 2017/0264001 | A1* | 9/2017 | Azad | H01Q 1/48 |

FOREIGN PATENT DOCUMENTS

| | | | |
|---|---|---|---|
| CN | 104584322 | A | 4/2015 |
| CN | 105024160 | A | 11/2015 |
| CN | 105140623 | A | 12/2015 |
| CN | 105305067 | A | 2/2016 |
| CN | 105789831 | A | 7/2016 |
| CN | 105789881 | A | 7/2016 |
| CN | 106374191 | A | 2/2017 |
| JP | 2015533047 | A | 11/2015 |
| JP | 3204587 | U | 6/2016 |
| WO | 2016103859 | A1 | 6/2016 |
| WO | WO-2016103859 | A1 * | 6/2016 ..... H01Q 1/24 |
| WO | 2016125556 | A1 | 8/2016 |

OTHER PUBLICATIONS

Machine Translation and Abstract of Chinese Publication No. CN105789831, Jul. 20, 2016, 11 pages.

Machine Translation and Abstract of Chinese Publication No. CN105789881, Jul. 20, 2016, 26 pages.

Foreign Communication From A Counterpart Application, PCT Application No. PCT/CN2017/078623, English Translation of International Search Report dated Dec. 14, 2017, 3 pages.

Foreign Communication From A Counterpart Application, PCT Application No. PCT/CN2017/078623, English Translation of Written Opinion dated Dec. 14, 2017, 4 pages.

* cited by examiner

ANTENNA AND TERMINAL DEVICE

CROSS-REFERENCE TO RELATED APPLICATIONS

This application is a national stage of International Application No. PCT/CN2017/078623, filed on Mar. 29, 2017, which is hereby incorporated by reference in its entirety.

TECHNICAL FIELD

This application relates to communications technologies, and in particular, to an antenna and a terminal device.

BACKGROUND

With development of communications technologies, a terminal device such as a mobile phone or a tablet computer usually has wireless communication functions such as cellular communication, Wireless Fidelity (Wireless Fidelity, Wi-Fi), and Bluetooth (Bluetooth).

To meet a requirement for a light and thin terminal device, an antenna is usually built in the device. In terms of housing materials, there may be a plastic housing, a metal housing, and the like. Due to an aesthetical requirement for appearance, a terminal device with a metal housing becomes increasingly popular because the metal housing has advantages in terms of, for example, texture, durability, and service life. However, because the metal housing shields an electromagnetic wave, a built-in antenna of the terminal device cannot receive/send a signal. To ensure normal communication of the terminal device, currently, a slot or groove may be provided on up and down edge components of the metal housing to form a slot antenna.

However, because an end of the slot antenna is usually bent to a longer side of the metal housing, when the terminal device is held in hand, antenna performance is likely to attenuate, and consequently communication performance deteriorates.

SUMMARY

Embodiments of this application provide an antenna and a terminal device, so as to reduce antenna performance attenuation caused by holding the terminal device in hand, and improve communication performance.

According to a first aspect, an embodiment of this application provides an antenna, including a metal frame and at least one resonating structure, where the metal frame is provided with a slot to form a first radiating element and a second radiating element on the metal frame;

the first radiating element includes at least one radiation arm, and each radiation arm is connected to a feedpoint of a terminal device on which the antenna is located; and the second radiating element includes at least one suspended radiation arm, each resonating structure includes one suspended radiation arm and a resonating component, the suspended radiation arm is connected to the resonating component, and the resonating component is further connected to a ground point of the terminal device.

The antenna provided in this embodiment of this application may enable one low-frequency bandwidth radiator to work even if another low-frequency bandwidth radiator is held in hand, thereby effectively improving antenna efficiency in a low-frequency operating band when the terminal device is held in hand, reducing antenna performance attenuation, and improving communication performance.

Optionally, the resonating component includes an inductance component, the suspended radiation arm is connected to the inductance component, and the inductance component is further connected to the ground point.

Optionally, the resonating component includes a capacitance component, the suspended radiation arm is connected to the capacitance component, and the capacitance component is further connected to the ground point.

Optionally, the resonating component includes an inductance component and a capacitance component, the inductance component is connected to the capacitance component, the inductance component is further connected to the suspended radiation arm, and the capacitance component is further connected to the ground point.

Optionally, the inductance component is an adjustable inductance component, and/or the capacitance component is an adjustable capacitance component.

In this embodiment of this application, antennas of different structures are provided when a plurality of different resonating structures are included, and an inductance component and/or a capacitance component of a resonating component may be configured as a component having a variable parameter value, so as to implement resonating structure switching between different resonance frequencies, thereby improving antenna radiation efficiency on each resonance frequency.

Optionally, the resonating component includes a first inductance component, a second inductance component, a first switch, and a second switch, the first inductance component is connected to the first switch, the second inductance component is connected to the second switch, the first inductance component and the second inductance component are further connected to the suspended radiation arm, and the first switch and the second switch are further connected to the ground point.

The antenna provided in this embodiment of this application can make an adjustment between different switch states, so as to implement resonating structure switching between different resonance frequencies, thereby improving antenna radiation efficiency on each resonance frequency.

Optionally, a shortest radiation arm in the first radiating element is further connected to a third inductance component and a fourth inductance component that are connected in parallel, the third inductance component is further connected to the ground point of the terminal device by using a third switch component, and the fourth inductance component is further connected to the ground point of the terminal device by using a fourth switch component.

In the antenna provided in this embodiment, antenna efficiency reduction caused when the antenna switches between different frequency bands in a low-frequency operating band can be effectively lessened.

Optionally, the third inductance component is further connected to a first capacitance component in parallel, and the fourth inductance component is further connected to the second capacitance component in parallel.

Optionally, a difference between a capacitance of the first capacitance component and an equivalent capacitance generated when the third switch is in a disconnected state is less than or equal to a preset value; and a difference between a capacitance of the second capacitance component and an equivalent capacitance generated when the fourth switch is in a disconnected state is less than or equal to a preset value.

The antenna in this embodiment of this application can further filter out a spurious wave.

Optionally, the slot is a PI-shaped slot or a U-shaped slot.

According to a second aspect, an embodiment of this application further provides a terminal device, including a printed circuit board PCB and an antenna, where the PCB includes a radio frequency processing unit and a baseband processing unit, the antenna is any one of the foregoing antennas, each radiation arm in the first radiating element in the antenna is connected to a feedpoint on the radio frequency processing unit, and the radio frequency processing unit is connected to the baseband processing unit;

the antenna is configured to transmit a received radio signal to the radio frequency processing unit, or send a transmit signal of the radio frequency processing unit;

the radio frequency processing unit is configured to: after processing the radio signal received by the antenna, send the radio signal to the baseband processing unit; or after processing a signal sent by the baseband processing unit, send the signal by using the antenna; and the baseband processing unit is configured to process the signal sent by the radio frequency processing unit.

According to the antenna and the terminal device provided in the embodiments of this application, the antenna may include the metal frame and the at least one resonating structure. The metal frame is provided with the slot to form the first radiating element and the second radiating element on the metal frame. The first radiating element includes the at least one radiation arm, and each radiation arm is connected to the feedpoint of the terminal device on which the antenna is located. The second radiating element includes the at least one suspended radiation arm. Each resonating structure includes the suspended radiation arm and the resonating component, and the suspended radiation arm is connected to the ground point of the terminal device by using the resonating component. The resonating structure is disposed in the antenna, so that in addition to a low-frequency bandwidth radiator included in the at least one radiation arm, the antenna may further include a low-frequency bandwidth radiator formed by the resonating structure. Therefore, even if one low-frequency bandwidth radiator is held in hand, another low-frequency bandwidth radiator may work, thereby effectively improving antenna efficiency in low-frequency bandwidth when the terminal device is held in hand, reducing antenna performance attenuation, and improving communication performance.

DESCRIPTION OF EMBODIMENTS

An antenna provided in the following embodiments of this application is applicable to a terminal device provided with a metal frame. A rear cover in the terminal device provided with the metal frame may be a non-metal rear cover, or may be a metal rear cover. For a terminal device having a non-metal rear cover, an inner surface of the non-metal rear cover of the terminal device may be covered by a metal layer, so as to provide a slot to form a radiation arm of an antenna and the like. The terminal device may be an electronic device having a wireless communication function, such as a mobile phone or a tablet computer. With reference to a plurality of instances, the following describes the antenna provided in the embodiments of this application.

Figure 1:
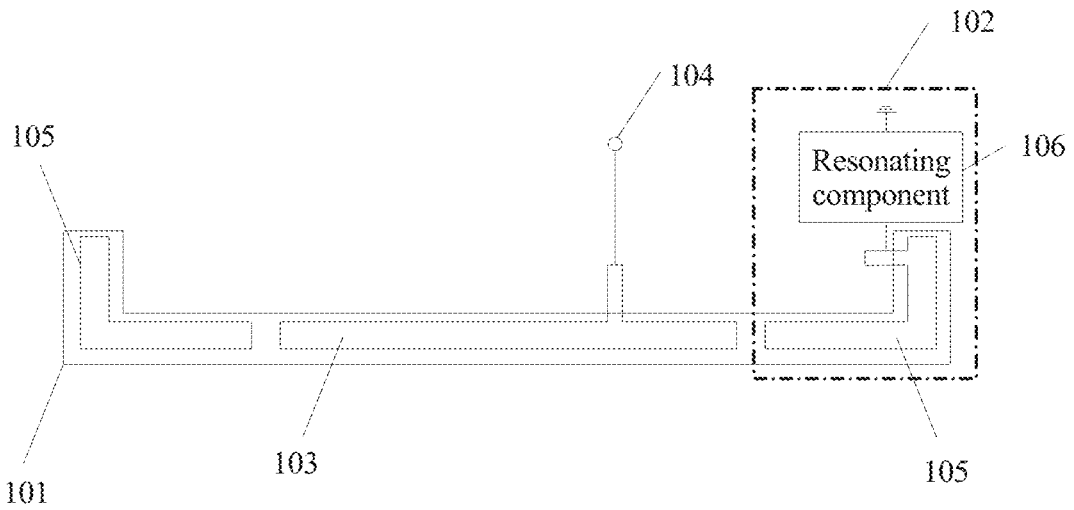
FIG. 1 is a schematic structural diagram 1 of an antenna according to an embodiment of this application.

FIG. 1 is a schematic structural diagram 1 of an antenna according to an embodiment of this application. As shown in FIG. 1, the antenna may include a metal frame 101 and at least one resonating structure (resonating structure) 102. The metal frame 101 is provided with a slot, and the slot is configured to form a first radiating element and a second radiating element on the metal frame 101.

The first radiating element includes at least one radiation arm 103, and each radiation arm 103 is connected to a feedpoint 104 of a terminal device on which the antenna is located.

The second radiating element includes at least one suspended radiation arm 105. Each resonating structure 102 includes one of the at least one suspended radiation arm 105 and a resonating component 106. The suspended radiation arm 105 is connected to the resonating component 106, and the resonating component 106 is further connected to a ground point of the terminal device.

Specifically, in the antenna shown in FIG. 1, the metal frame 101 may be a partial frame of the terminal device, for example, a top frame or a bottom frame. There may be a plurality of slots on the metal frame 101, for example, two slots or four slots. In FIG. 1, four slots are used as an example for description.

If there are a plurality of slots on the metal frame 101, at least one of the plurality of slots may be connected outside the terminal device. In this case, the plurality of slots are still presented on an appearance surface. Optionally, if there are a plurality of slots on the metal frame 101, at least one of the plurality of slots may be connected inside the terminal device. In this case, there are the plurality of slots on an appearance surface, but an actual quantity of antenna slots is less than the plurality of slots.

The at least one of the plurality of slots on the metal frame 101 is connected, thereby improving low-frequency bandwidth antenna efficiency by using the resonating structure 102 while improving an appearance of the terminal device.

Optionally, in any one of the foregoing antennas, the slot may be a PI-shaped slot or a U-shaped slot.

Figure 2:
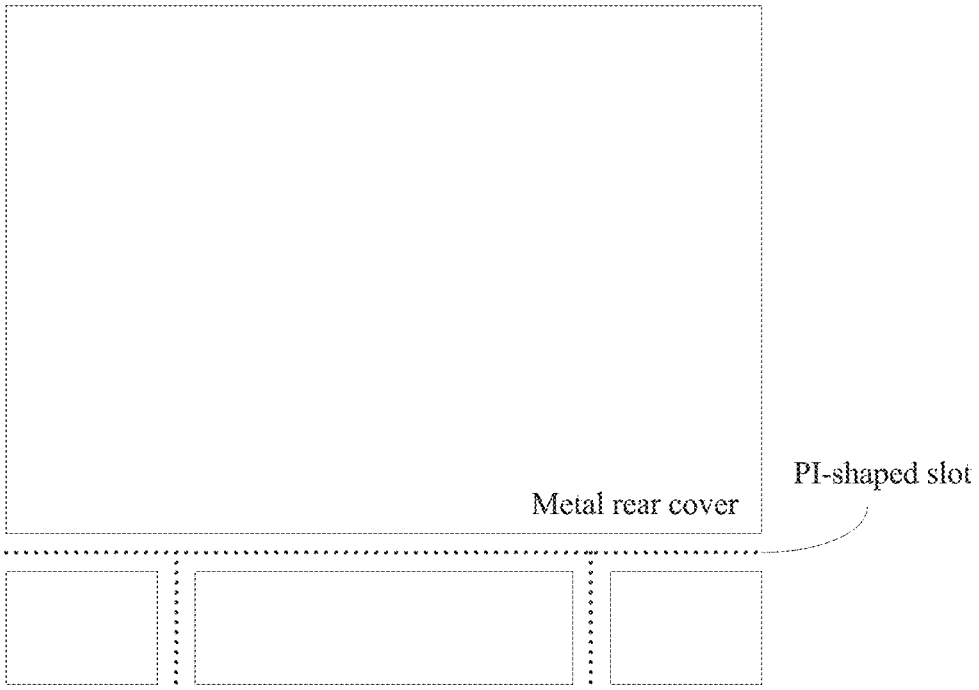
FIG. 2 is a schematic structural diagram of a PI-shaped slot in an antenna according to an embodiment of this application.
Figure 3:
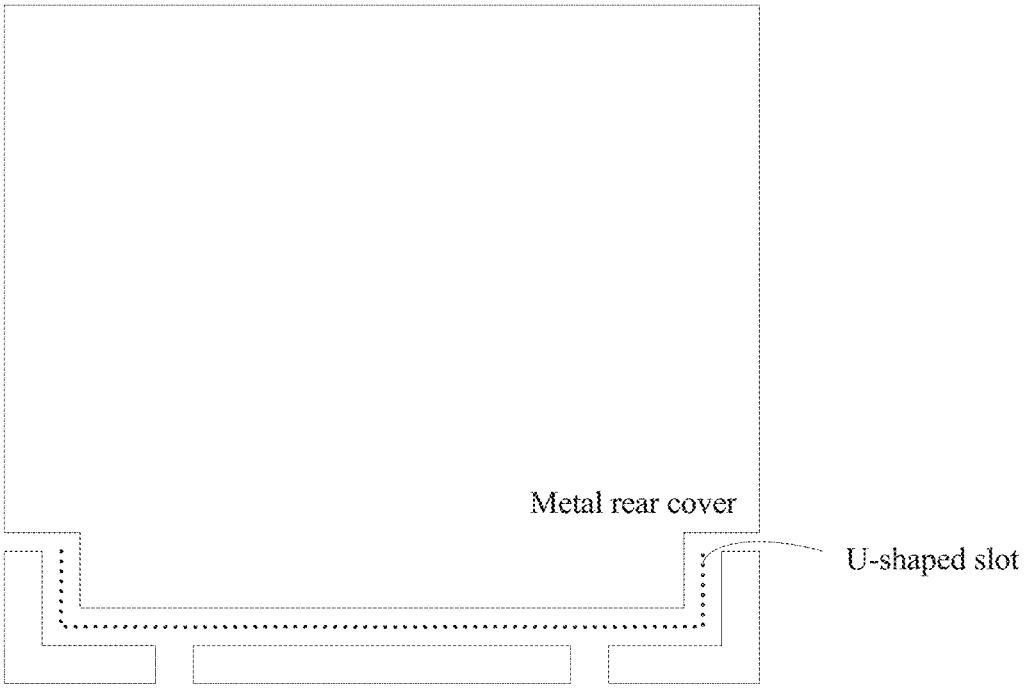
FIG. 3 is a schematic structural diagram of a U-shaped slot in an antenna according to an embodiment of this application.

For example, FIG. 2 is a schematic structural diagram of a PI-shaped slot in an antenna according to an embodiment of this application, and FIG. 3 is a schematic structural diagram of a U-shaped slot in an antenna according to an embodiment of this application.

Referring to FIG. 2, it can be learned that the PI-shaped slot on the metal frame 101 may be a PI-shaped slot provided on a metal rear cover of the terminal device. Referring to FIG. 3, it can be learned that the U-shaped slot on the metal frame 101 may be a U-shaped slot provided on a metal rear cover of the terminal device.

In the at least one radiation arm 103 shown above, a longer radiation arm indicates a smaller radiation frequency corresponding to the radiation arm. On the contrary, a shorter radiation arm indicates a larger radiation frequency corresponding to the radiation arm.

An example in which the first radiating element includes two radiation arms 103 is used in FIG. 1. A longer radiation arm may be a radiation arm of low-frequency bandwidth, and a radiation frequency corresponding to the longer radiation arm may be any frequency in the low-frequency bandwidth. A shorter radiation arm may be a radiation arm of an intermediate frequency or a high frequency, and a radiation frequency corresponding to the shorter radiation arm may be any frequency in intermediate frequency bandwidth or high frequency bandwidth. The low-frequency bandwidth may be, for example, 698 MHz to 960 MHz, the intermediate frequency bandwidth may be 1710 MHz to 2170 MHz, and the high frequency bandwidth may be 2300 MHz to 2690 MHz.

By using a lumped device with a preset resistance, each radiation arm 103 may be connected to the feedpoint 104 of the terminal device on which the antenna is located, so that a signal that is output by the feedpoint 104 is transmitted to each radiation arm 103, and radiates by using the radiation arm 103, so as to implement radio signal sending. In addition, a signal received by each radiation arm 103 may be transmitted to the feedpoint 104, so as to implement radio signal receiving.

The feedpoint 104 may be located on a radio frequency processing unit of the terminal device.

Each resonating structure 102 may also be referred to as a resonating element (resonating element). Each resonating structure 102 may be corresponding to one fixed frequency in a preset frequency band, or may be corresponding to at least one variable frequency in the preset frequency band. A specific resonance frequency corresponding to each resonating structure 102 may be determined based on a length of the suspended radiation arm 105 in the resonating structure 102, a resonant parameter of the resonating component 106, and the like.

A preset frequency band corresponding to each resonating structure 102 may have low-frequency bandwidth. Therefore, each resonating structure 102 may be referred to as a low-frequency resonating structure. The ground point of the terminal device may be any ground point in any unit structure such as the radio frequency processing unit or a baseband processing unit in the terminal device.

In the antenna shown in FIG. 1, each resonating structure 102 may be electrically connected to the feedpoint 104 through coupling, and each resonating structure 102 may excite, by using the resonating component 106, a current on a substrate on which the ground point is located. Combined with the suspended radiation arm 105, the resonating structure 102 can receive and send any frequency signal in the low-frequency bandwidth. The substrate may be a printed circuit board (Printed Circuit Board, PCB).

In the at least one resonating structure 102, a resonating structure 102 close to the feedpoint 104 may be electrically connected to the feedpoint 104 through magnetic field coupling. In the at least one resonating structure 102, a resonating structure 102 far away from the feedpoint 104 may be electrically connected to the feedpoint 104 through electric field coupling. An example in which the antenna in FIG. 1 includes one resonating structure 102 is used for description. The resonating structure 102 shown in FIG. 1 may be close to the feedpoint. For example, a suspended radiation arm 105 of the resonating structure 102 is a suspended radiation arm 105 closest to the feedpoint 104 in the second radiating element.

If there is one resonating structure 102, the resonating structure 102 may include any one of the at least one suspended radiation arm 105. If there are a plurality of resonating structures 102, a quantity of resonating structures 102 may be less than or equal to a quantity of at least one suspended radiation arm 105.

Figure 4:
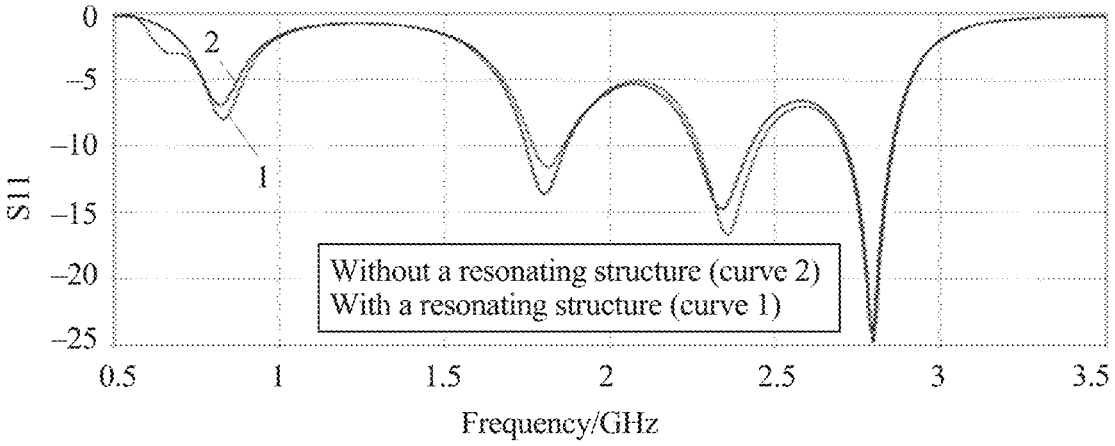
FIG. 4 is a diagram comparing a reflection coefficient of an antenna with a reflection coefficient of a conventional antenna according to an embodiment of this application.
Figure 5:
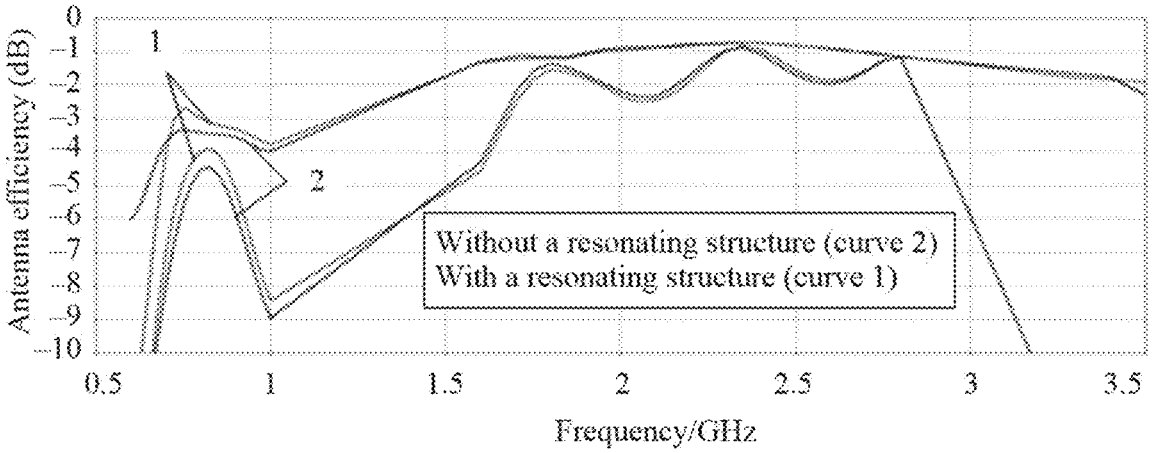
FIG. 5 is a diagram comparing antenna efficiency of an antenna with antenna efficiency of a conventional antenna according to an embodiment of this application.

FIG. 4 is a diagram comparing a reflection coefficient of an antenna with a reflection coefficient of a conventional antenna according to an embodiment of this application. FIG. 5 is a diagram comparing antenna efficiency of an antenna with antenna efficiency of a conventional antenna according to an embodiment of this application. A curve 1 in FIG. 4 is a curve of a relationship between a frequency and a reflection coefficient of the antenna in this embodiment of this application, namely, an antenna with a resonating structure. A curve 2 in FIG. 4 is a curve of a relationship between a frequency and a reflection coefficient of a conventional antenna, namely, an antenna without a resonating structure. A transmit coefficient of the antenna may be an input reflection coefficient, which may be represented as $S_{11}$ shown in FIG. 4. A curve 1 in FIG. 5 is a curve of a relationship between a frequency and antenna efficiency of the antenna in this embodiment of this application. A curve 2 in FIG. 5 is a curve of a relationship between a frequency and antenna efficiency of a conventional antenna.

Referring to FIG. 4, it can be learned that the reflection coefficient of the antenna provided in this embodiment of this application is less than the reflection coefficient of the conventional antenna in low-frequency bandwidth. As a result, it may be determined that a return loss of the antenna in this embodiment of this application is less than a return loss of the conventional antenna in the low-frequency bandwidth. Referring to FIG. 5, it can be learned that the antenna efficiency of the antenna provided in this embodiment of this application is greater than the antenna efficiency of the conventional antenna in low-frequency bandwidth. With reference to FIG. 4 and FIG. 5, it can be learned that the resonating structure 103 shown in FIG. 1 is added to the antenna in this embodiment of this application, thereby effectively reducing the return loss of the antenna in the low-frequency bandwidth, and improving radiation efficiency of the antenna in the low-frequency bandwidth.

In addition to a low-frequency bandwidth radiator included in the at least one radiation arm 104, the antenna in this embodiment of this application further includes a low-frequency bandwidth radiator formed by the resonating structure 103. Therefore, even if one low-frequency bandwidth radiator is held in hand, another low-frequency bandwidth radiator may work, thereby ensuring antenna efficiency in low-frequency bandwidth.

Figure 6:
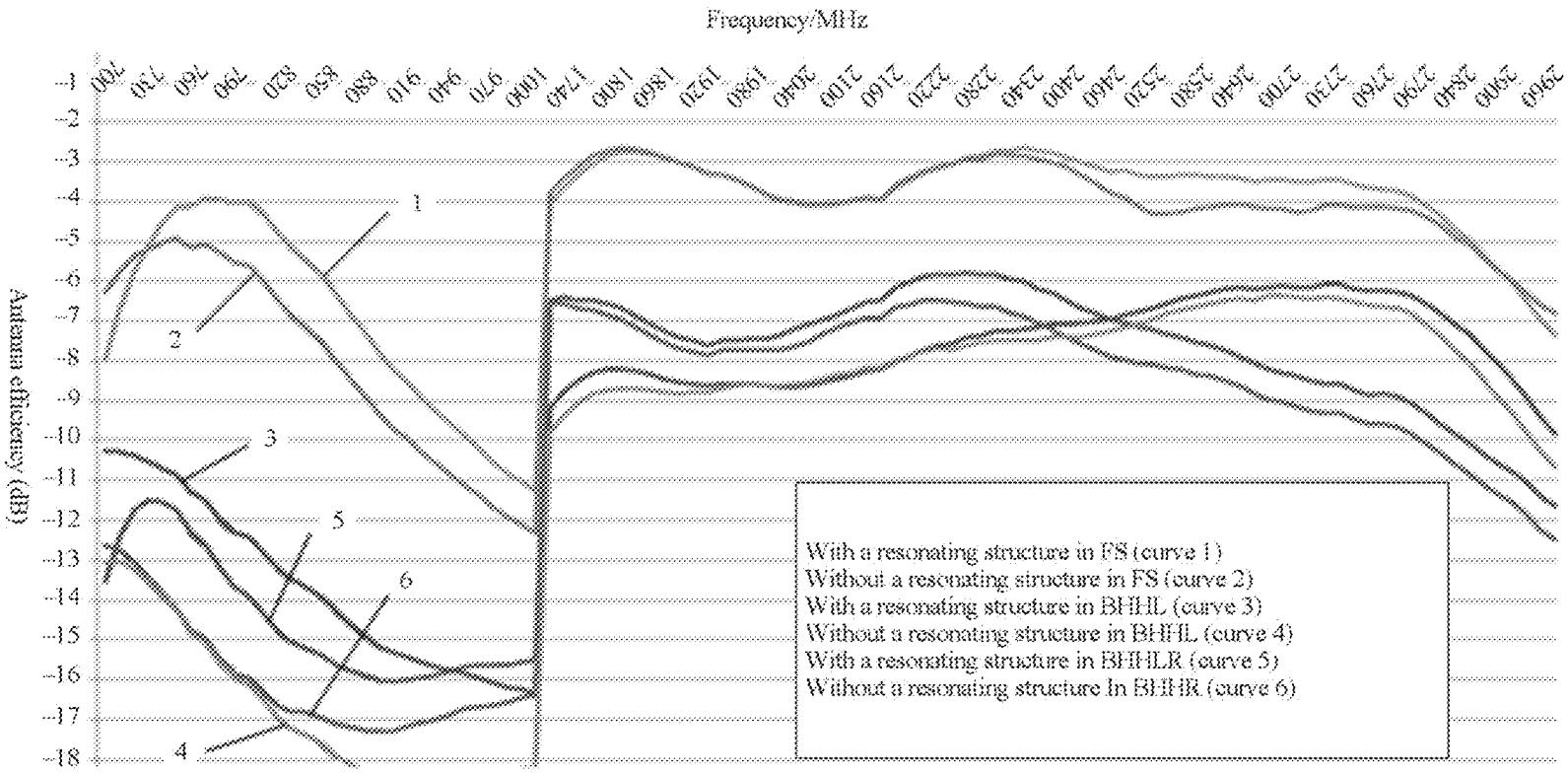
FIG. 6 is a diagram comparing antenna efficiency of an antenna with antenna efficiency of a conventional antenna in a hand phantom test according to an embodiment of this application.

FIG. 6 is a diagram comparing antenna efficiency of an antenna with antenna efficiency of a conventional antenna in a hand phantom test according to an embodiment of this application. A curve 1 is a curve of a relationship between antenna efficiency and a frequency when the antenna in this embodiment of this application is in a free space (Free Space, FS) mode. A curve 2 is a curve of a relationship between antenna efficiency and a frequency when a conventional antenna is in an FS mode. A curve 3 is a curve of a relationship between antenna efficiency and a frequency when the antenna in this embodiment of this application is in a beside head and hand at left (Beside Head and Hand at Left, BHHL) mode. A curve 4 is a curve of a relationship between antenna efficiency and a frequency when a conventional antenna is in a BHHL mode. A curve 5 is a curve of a relationship between antenna efficiency and a frequency when the antenna in this embodiment of this application is in a beside head and hand at right (Beside Head and Hand at Right, BHHR) mode. A curve 6 is a curve of a relationship between antenna efficiency and a frequency when a conventional antenna is in a BHHR mode.

Referring to FIG. 6, it can be learned that, whether the antenna in this embodiment of this application is in the FS mode, the BHHL mode, or the mode, the antenna efficiency of the antenna in low-frequency bandwidth is greater than the antenna efficiency of the conventional antenna. Therefore, the antenna in this embodiment of this application can not only improve antenna efficiency in the FS mode, but also improve antenna efficiency in a left and right hand mode in the low-frequency bandwidth.

The antenna provided in this embodiment of this application may include a metal frame and at least one resonating structure. The metal frame is provided with a slot to form a first radiating element and a second radiating element on the metal frame. The first radiating element includes at least one radiation arm, and each radiation arm is connected to a feedpoint of a terminal device on which the antenna is located. The second radiating element includes at least one suspended radiation arm. Each resonating structure includes one suspended radiation arm and a resonating component, and the suspended radiation arm is connected to the ground point of the terminal device by using the resonating component. The resonating structure is disposed in the antenna, so that in addition to a low-frequency bandwidth radiator included in the at least one radiation arm, the antenna may further include a low-frequency bandwidth radiator formed by the resonating structure. Therefore, even if one low-frequency bandwidth radiator is held in hand, another low-frequency bandwidth radiator may work, thereby effectively improving antenna efficiency in low-frequency bandwidth when the terminal device is held in hand, reducing antenna performance attenuation, and improving communication performance.

Figure 7:
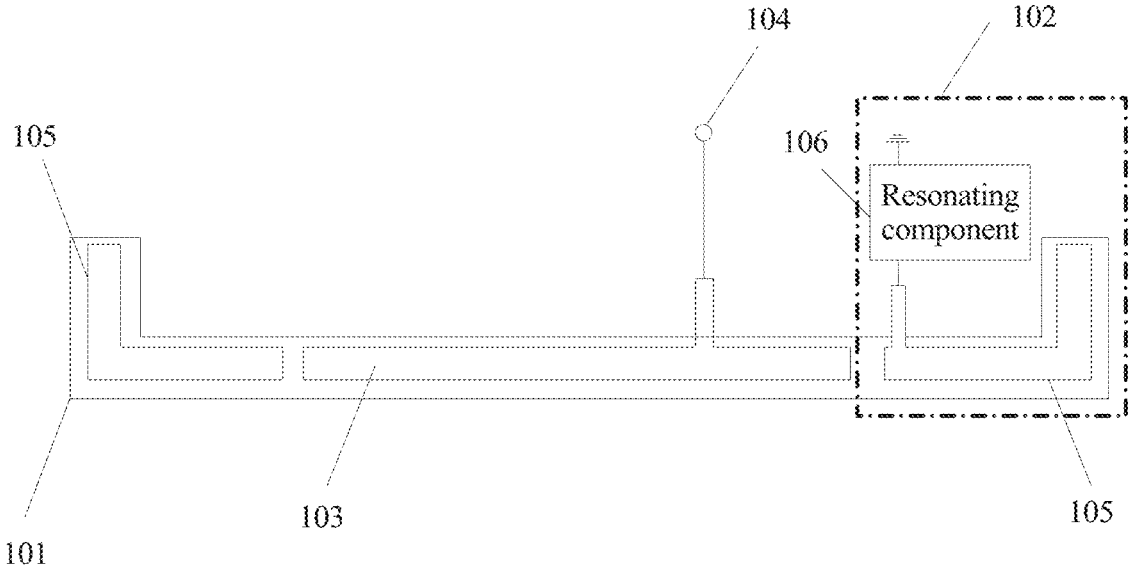
FIG. 7 is a schematic structural diagram 2 of an antenna according to an embodiment of this application.

Optionally, based on the antenna shown in FIG. 1, an embodiment of this application may further provide an antenna. FIG. 7 is a schematic structural diagram 2 of an antenna according to an embodiment of this application. As shown in FIG. 7, in the foregoing antenna, the resonating component 106 in each resonating structure may be further connected to another end of the suspended radiation arm 105 in each resonating structure.

Figure 8:
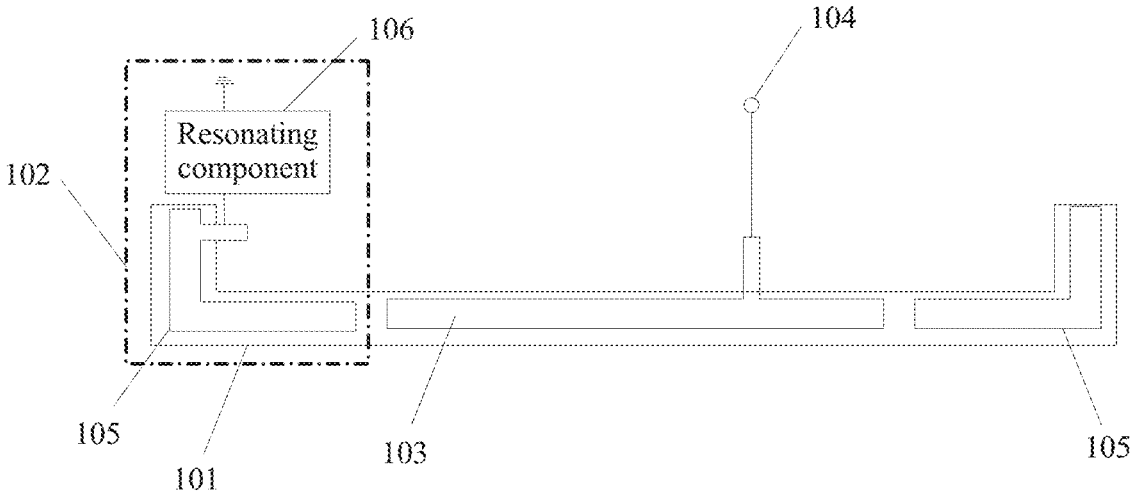
FIG. 8 is a schematic structural diagram 3 of an antenna according to an embodiment of this application.

Optionally, based on the antenna shown in FIG. 1, an embodiment of this application may further provide an antenna. FIG. 8 is a schematic structural diagram 3 of an antenna according to an embodiment of this application. As shown in FIG. 8, if the foregoing antenna includes one resonating structure 102, the resonating structure 102 may be far away from the feedpoint. For example, a suspended radiation arm 105 of the resonating structure 102 is a suspended radiation arm 105 farthest from the feedpoint 104 in the second radiating element.

Figure 9:
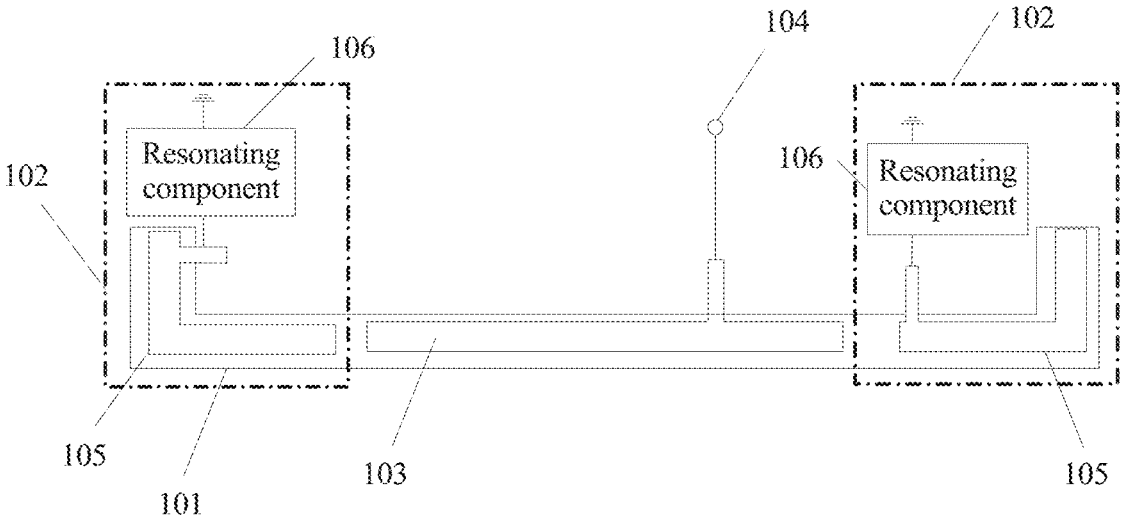
FIG. 9 is a schematic structural diagram 4 of an antenna according to an embodiment of this application.

Optionally, based on the antenna shown in FIG. 1, an embodiment of this application may further provide an antenna. FIG. 9 is a schematic structural diagram 4 of an antenna according to an embodiment of this application. As shown in FIG. 9, in the foregoing antenna, if there are a plurality of resonating structures 102, a quantity of resonating structures 102 is equal to a quantity of at least one suspended radiation arm 105. Two suspended radiation arms 105 are used as an example. The antenna shown in FIG. 9 may include two resonating structures, and each resonating structure 102 includes either of the suspended radiation arms 105 and a resonating component 106.

This embodiment of this application provides locations of a plurality of different resonating structures, and provides antennas of a plurality of different structures.

Figure 10:
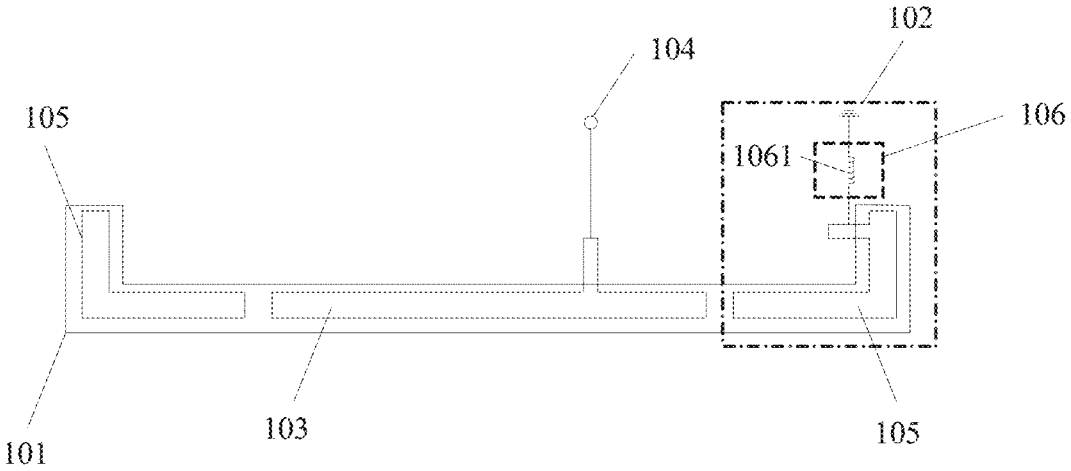
FIG. 10 is a schematic structural diagram 5 of an antenna according to an embodiment of this application.

Optionally, an embodiment of this application further provides an antenna. FIG. 10 is a schematic structural diagram 5 of an antenna according to an embodiment of this application. Optionally, as shown in FIG. 10, in the foregoing antenna, the resonating component 106 includes an inductance component 1061. The suspended radiation arm 105 is connected to the inductance component 1061, and the inductance component 1061 is further connected to the ground point.

The inductance component 1061 may be an inductance component having a preset fixed inductance, or may be an adjustable inductance component having a preset inductance range.

Figure 11:
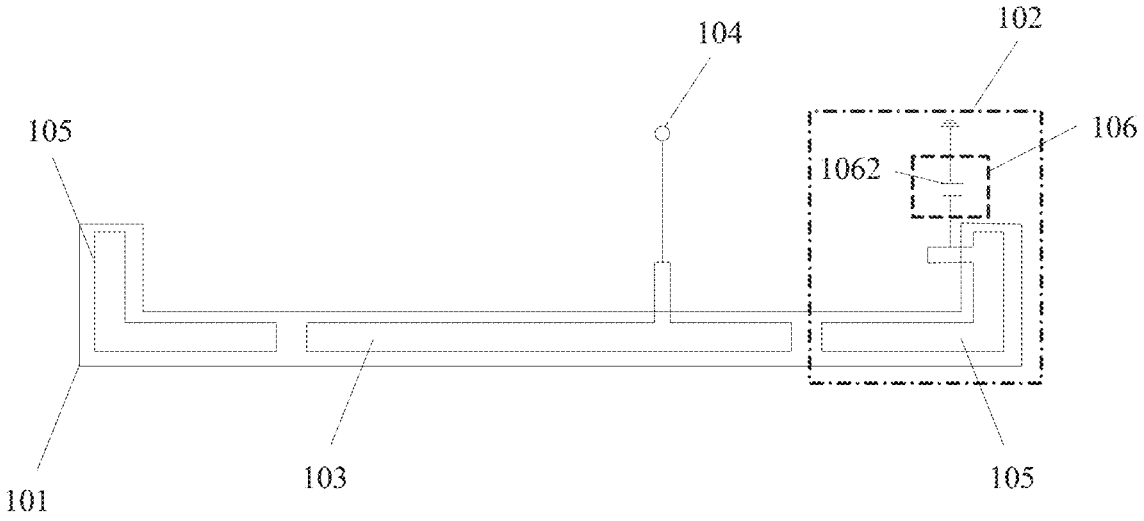
FIG. 11 is a schematic structural diagram 6 of an antenna according to an embodiment of this application.

FIG. 11 is a schematic structural diagram 6 of an antenna according to an embodiment of this application. Optionally, as shown in FIG. 11, in the foregoing antenna, the resonating component 106 includes a capacitance component 1062. The suspended radiation arm 106 is connected to the capacitance component 1062, and the capacitance component 1062 is further connected to the ground point.

The capacitance component 1062 may be a capacitance component having a preset fixed capacitance, or may be a variable capacitance component having a preset capacitance range.

Figure 12:
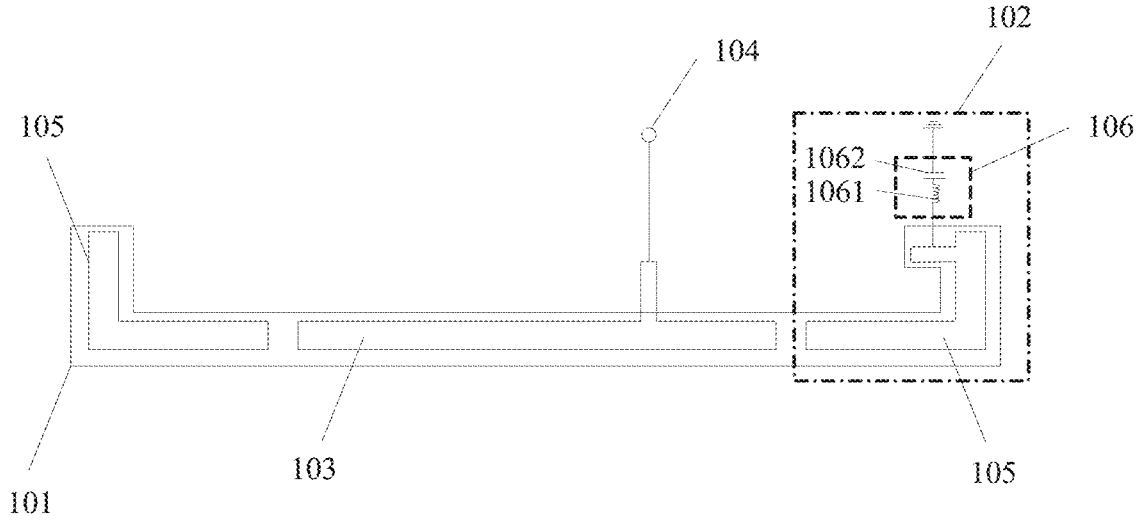
FIG. 12 is a schematic structural diagram 7 of an antenna according to an embodiment of this application.

FIG. 12 is a schematic structural diagram 7 of an antenna according to an embodiment of this application. Optionally, as shown in FIG. 12, in the foregoing antenna, the resonating component 106 includes an inductance component 1061 and a capacitance component 1062. The inductance component 1061 is connected to the capacitance component 1062, the inductance component 1061 is further connected to the suspended radiation arm 105, and the capacitance component 1062 is further connected to the ground point.

Optionally, the inductance component 1061 shown in FIG. 12 may be an adjustable inductance component, and/or the capacitance component 1062 may be an adjustable capacitance component.

In this embodiment of this application, antennas of different structures are provided when a plurality of different resonating structures are included, and an inductance component and/or a capacitance component of a resonating component may be configured as a component having a variable parameter value, so as to implement resonating structure switching between different resonance frequencies, thereby ensuring antenna radiation efficiency on each resonance frequency.

Figure 13:
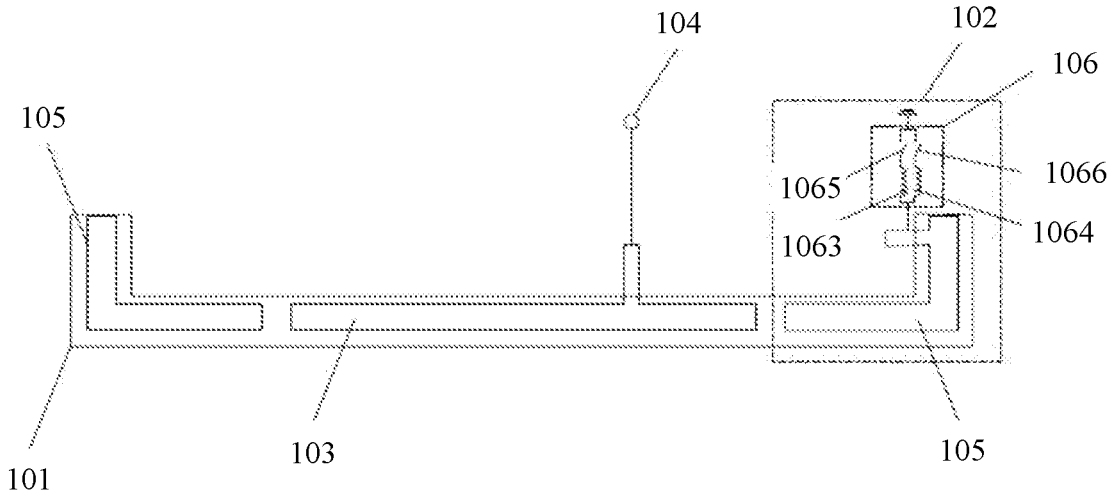
FIG. 13 is a schematic structural diagram 8 of an antenna according to an embodiment of this application.

Optionally, an embodiment of this application further provides an antenna. FIG. 13 is a schematic structural diagram 8 of an antenna according to an embodiment of this application. As shown in FIG. 13, in the foregoing antenna, the resonating component 106 includes: a first inductance component 1063, a second inductance component 1064, a first switch 1065, and a second switch 1066. The first inductance component 1063 is connected to the first switch 1065, and the second inductance component 1064 is connected to the second switch 1066. The first inductance component 1063 and the second inductance component 1064 are further connected to the suspended radiation arm 105. The first switch 1065 and the second switch 1066 are further connected to the ground point.

It should be noted that alternatively the first inductance component 1063 and the second inductance component 1064 may be connected to the ground point, and the first switch 1065 and the second switch 1066 are connected to the suspended radiation arm 105. FIG. 13 is a connection manner of only one instance. Details are not described herein again.

The first switch 1065 and the second switch 1066 each may be a radio frequency switch (Radio Frequency Switch).

The antenna provided in this embodiment of this application can make an adjustment between different switch states, so as to implement resonating structure switching between different resonance frequencies, thereby ensuring antenna radiation efficiency on each resonance frequency.

If the antenna shown in FIG. 13 works in low-frequency bandwidth, the suspended radiation arm 105 in the resonating structure 102 is equivalent to an open circuit. When the antenna works in the low-frequency bandwidth, and a finger is not in contact with an antenna slot, the first switch 1065 and/or the second switch 1066 may be adjusted in status, so that an inductance of the inductance component connected to the suspended radiation arm 105 is greater than a preset inductance. The inductance component connected to the suspended radiation arm 105 may be referred to as a large inductor L1, and the inductance of the large inductor may be, for example, 36 nH.

When a finger of a user is in contact with an antenna slot during use of a mobile phone, the first switch 1065 and/or the second switch 1066 may be adjusted in status, so that an inductance of the inductance component connected to the suspended radiation arm 105 is less than a preset inductance. In this case, the inductance component connected to the suspended radiation arm 105 may be referred to as a small inductor L1, and the inductance of the small inductor may be, for example, 6.8 nH. In this case, from the antenna feedpoint to a relatively short radiation arm in the first radiating element, to the finger, to the suspended radiation arm 105, and through the small inductor, to the ground, a new resonance frequency of a ¾ wavelength is formed. The new resonance frequency may be tuned by using the grounded small inductor L0, and the new resonance frequency may be, for example, near an intermediate frequency 1710 MHz. Therefore, the antenna provided in this embodiment of this application can further effectively avoid antenna efficiency attenuation caused when a finger is in contact with an antenna slot in intermediate frequency bandwidth and high frequency bandwidth. Compared with a conventional antenna, the antenna can have an increase of at least 7.5 dB in antenna efficiency, thereby effectively ensuring communication quality of the user.

Figure 14:
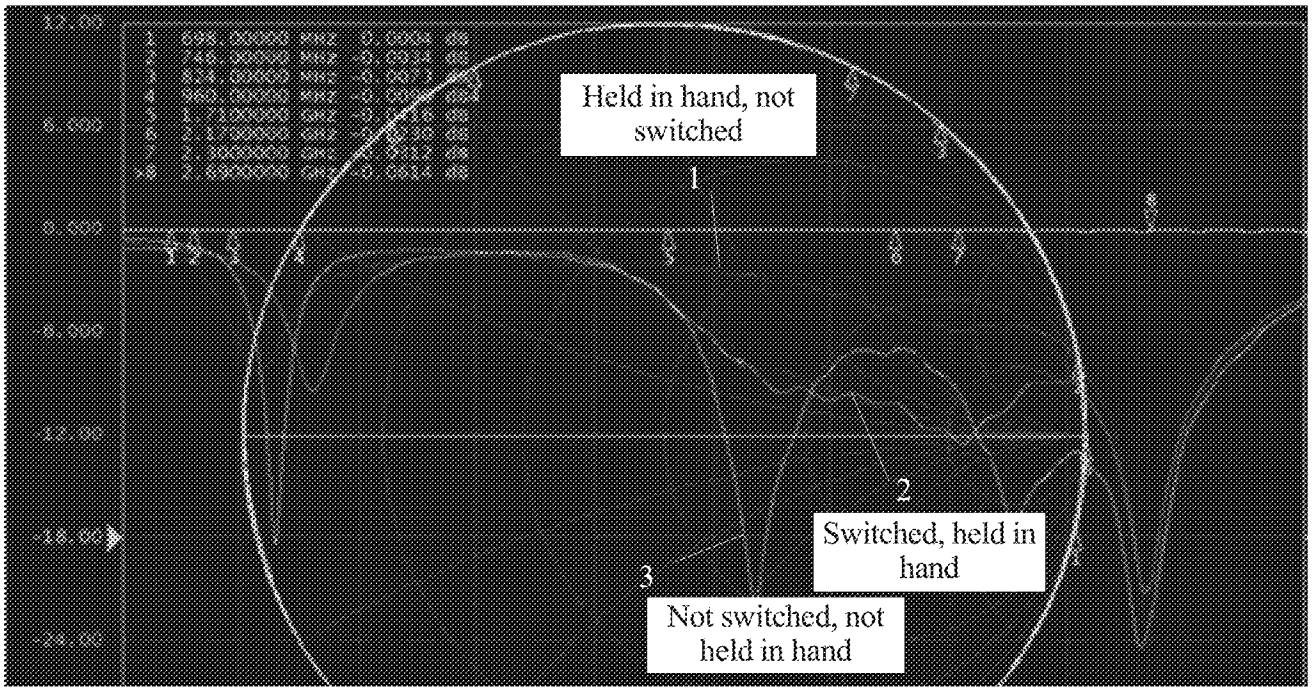
FIG. 14 is a diagram 1 comparing antenna efficiency of an antenna in various states according to an embodiment of this application.
Figure 15:
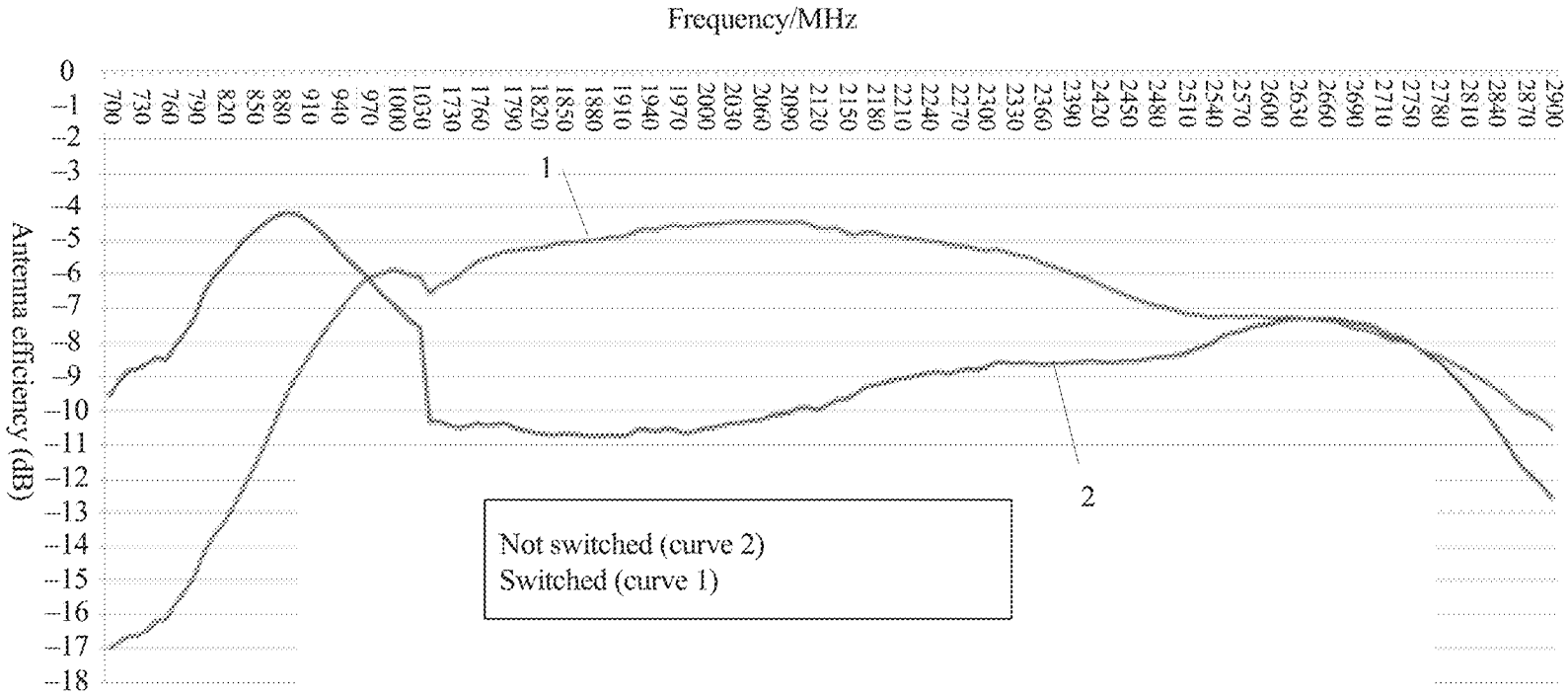
FIG. 15 is a diagram 2 comparing antenna efficiency of an antenna in various states according to an embodiment of this application.

For example, FIG. 14 is a diagram 1 comparing antenna efficiency of an antenna in various states according to an embodiment of this application, and FIG. 15 is a diagram 2 comparing antenna efficiency of an antenna in various states according to an embodiment of this application.

A curve 1 in FIG. 14 is a curve of a relationship between antenna efficiency and a frequency when an inductance connected to a suspended radiation arm in a resonating structure is not switched to a small inductor and an antenna slot is held in hand. A curve 2 in FIG. 14 is a curve of a relationship between antenna efficiency and a frequency when an inductance connected to a suspended radiation arm in a resonating structure is switched to a small inductor and an antenna slot is held in hand. A curve 3 in FIG. 14 is a curve of a relationship between antenna efficiency and a frequency when an inductance connected to a suspended radiation arm in a resonating structure is not switched to a small inductor and an antenna slot is not held in hand.

A curve 1 in FIG. 15 is a curve of a relationship between antenna efficiency and a frequency when an inductance connected to a suspended radiation arm in a resonating structure is switched to a small inductor and an antenna slot is held in hand. A curve 2 in FIG. 15 is a curve of a relationship between antenna efficiency and a frequency when an inductance connected to a suspended radiation arm in a resonating structure is not switched to a small inductor and an antenna slot is held in hand.

Referring to FIG. 14 and FIG. 15, it can be learned that switching an inductance connected to a suspended radiation arm in a resonating structure to a small inductor can effectively improve antenna efficiency when a finger is in contact with an antenna slot.

Figure 16:
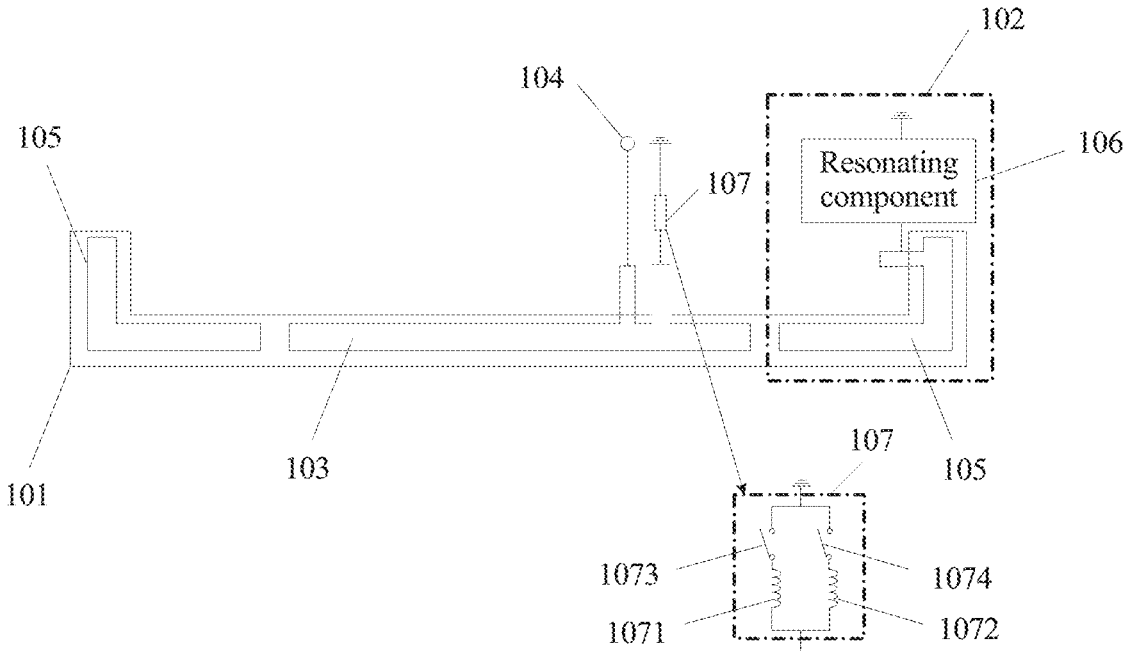
FIG. 16 is a schematic structural diagram 9 of an antenna according to an embodiment of this application.

Optionally, an embodiment of this application further provides an antenna. FIG. 16 is a schematic structural diagram 9 of an antenna according to an embodiment of this application. As shown in FIG. 16, based on the foregoing antenna, a shortest radiation arm in the first radiating element in the antenna is further connected to a transfer switch 107, and the transfer switch 107 is further connected to the ground point of the terminal device.

The transfer switch 107 includes a third inductance component 1071 and a fourth inductance component 1072 that are connected in parallel. The third inductance component 1071 is further connected to the ground point of the terminal device by using a third switch component 1073, and the fourth inductance component 1072 is further connected to the ground point of the terminal device by using a fourth switch component 1074.

In the antenna provided in this embodiment, the transfer switch 107 is disposed on a side of the shortest radiation arm, thereby effectively lessening antenna efficiency reduction caused by a frequency increase in low-frequency bandwidth. The third switch component 1073 and the fourth switch component 1074 included in the transfer switch 107 are two single-pole single-throw switches. Therefore, the switches in the transfer switch 107 may be referred to as a double-pole double-throw switch. Switching is performed between three switch states of the third switch component 1073 and the fourth switch component 1074, so that a radiation frequency of the shortest radiation arm in the antenna may separately cover different ranges within the low-frequency bandwidth (698 MHz to 960 MHz), for example, a first frequency band (698 MHz to 787 MHz) including 700 MHz, a second frequency band (814 MHz to 894 MHz) including 800 MHz, and a third frequency band (880 MHz to 960 MHz) including 900 MHz. A first switch state in the three switch states is both the third switch component 1073 and the fourth switch component 1074 are disconnected; a second switch state in the three switch states is either the third switch component 1073 or the fourth switch component 1074 is disconnected; and a third switch state in the three switch states is both the third switch component 1073 and the fourth switch component 1074 are closed.

In the first switch state, the radiation frequency of the shortest radiation arm in the antenna may cover the first frequency band (698 MHz to 787 MHz) including 700 MHz in the low-frequency bandwidth (698 MHz to 960 MHz). In the second switch state, the radiation frequency of the shortest radiation arm in the antenna may cover the second frequency band (814 MHz to 894 MHz) including 800 MHz in the low-frequency bandwidth (698 MHz to 960 MHz). In the third switch state, the radiation frequency of the shortest radiation arm in the antenna may cover the third frequency band (880 MHz to 960 MHz) including 900 MHz in the low-frequency bandwidth (698 MHz to 960 MHz).

Figure 17:
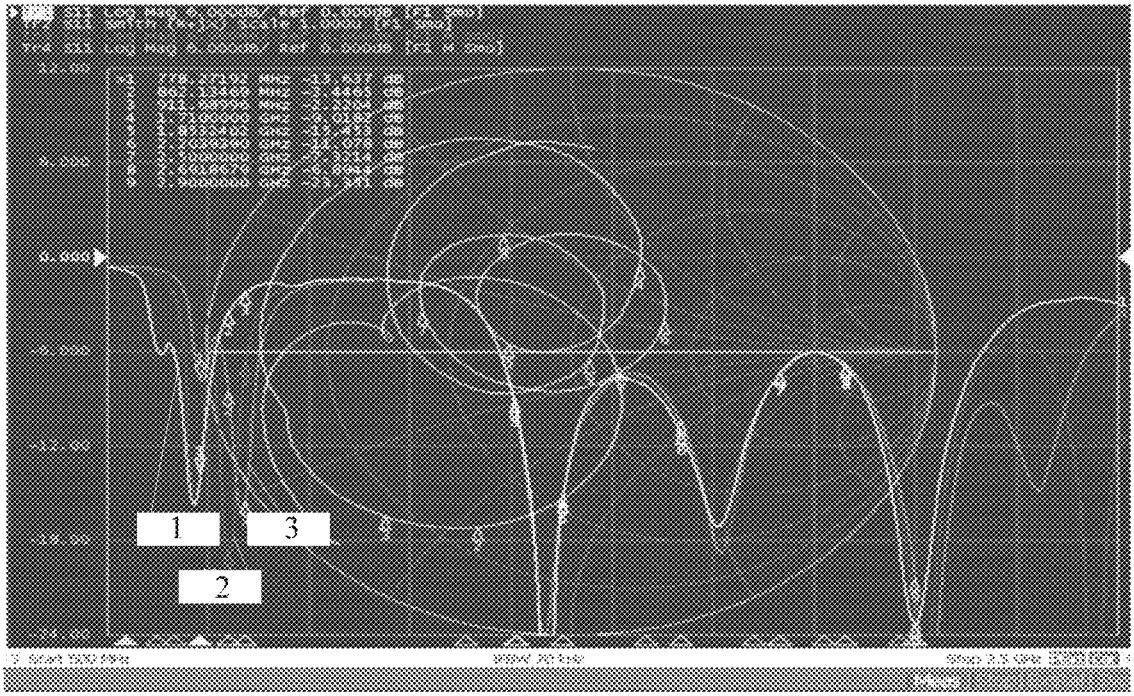
FIG. 17 is a diagram 1 comparing antenna efficiency of a transfer switch in an antenna in various switch states according to an embodiment of this application.
Figure 18:
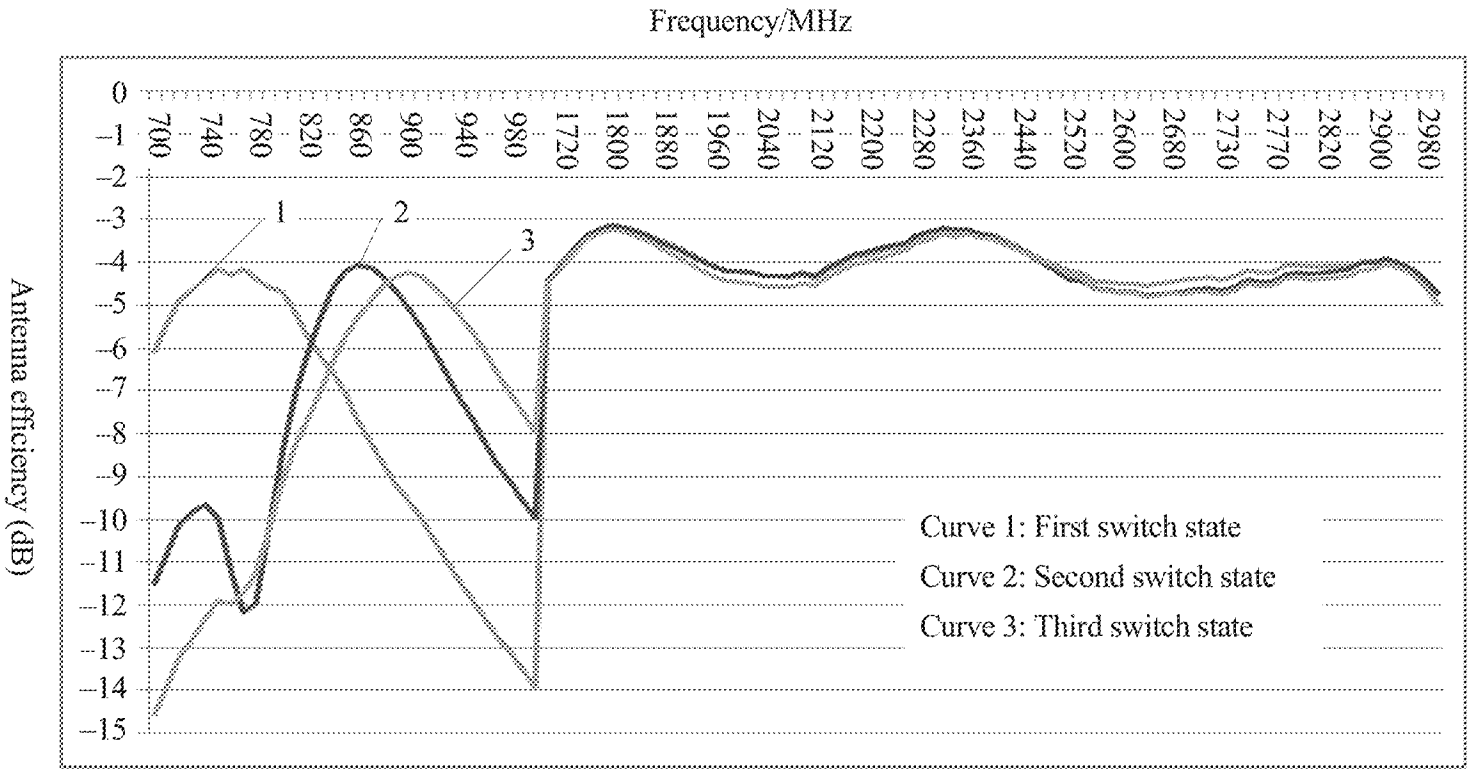
FIG. 18 is a diagram 2 comparing antenna efficiency of a transfer switch in an antenna in various switch states according to an embodiment of this application.

For example, FIG. 17 is a diagram 1 comparing antenna efficiency of a transfer switch in an antenna in various switch states according to an embodiment of this application, and FIG. 18 is a diagram 2 comparing antenna efficiency of a transfer switch in an antenna in various switch states according to an embodiment of this application.

A curve 1 in FIG. 17 and FIG. 18 is a curve of a relationship between antenna efficiency and a frequency in a first switch state. A curve 2 in FIG. 17 and FIG. 18 is a curve of a relationship between antenna efficiency and a frequency in a second switch state. A curve 3 in FIG. 17 and FIG. 18 is a curve of a relationship between antenna efficiency and a frequency in a third switch state. The first switch state is both the third switch component 1073 and the fourth switch component 1074 are disconnected; the second switch state is either the third switch component 1073 or the fourth switch component 1074 is disconnected; and the third switch state is both the third switch component 1073 and the fourth switch component 1074 are closed.

Referring to FIG. 17 and FIG. 18, it can be learned that, in the first switch state, a radiation frequency of a longest radiation arm in the antenna in this embodiment of this application may cover the first frequency band in the low-frequency bandwidth, thereby ensuring antenna efficiency in the first frequency band; in the second switch state, a radiation frequency of a longest radiation arm in the antenna in this embodiment of this application may cover the second frequency band in the low-frequency bandwidth, thereby ensuring antenna efficiency in the second frequency band; and in the third switch state, a radiation frequency of a longest radiation arm in the antenna in this embodiment of this application may cover the third frequency band in the low-frequency bandwidth, thereby ensuring antenna efficiency in the third frequency band.

Figure 19:
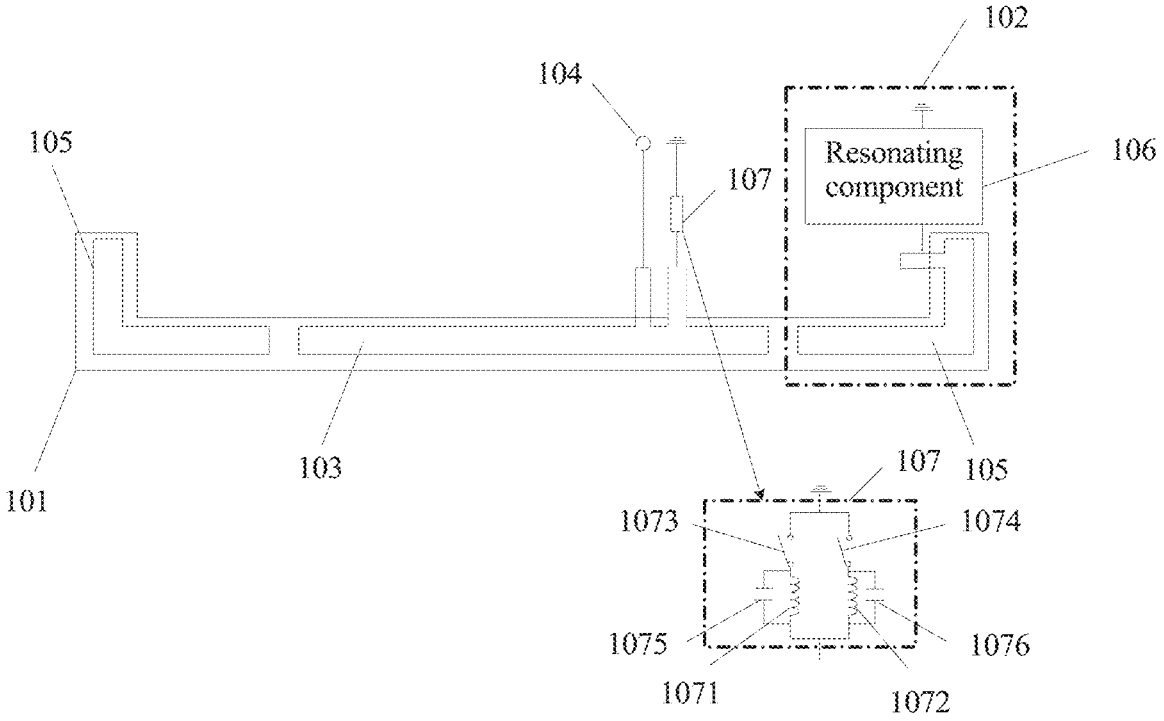
FIG. 19 is a schematic structural diagram 10 of an antenna according to an embodiment of this application.

Optionally, an embodiment of this application further provides an antenna. FIG. 19 is a schematic structural diagram 10 of an antenna according to an embodiment of this application. As shown in FIG. 19, the third inductance component 1071 in the foregoing antenna is further connected to a first capacitance component 1075 in parallel, and the fourth inductance component 1072 is further connected to a second capacitance component 1076 in parallel.

A parasitic capacitor is disposed inside each of the third switch component 1073 and the fourth switch component 1074. During disconnection, the parasitic capacitor may be equivalent to one small capacitor $C_{Off}$, and a capacitance of the small capacitor may be, for example, 0.3 pF.

If the first switch component 1073 and/or the second switch component 1074 are/is disconnected, the parasitic capacitor in each switch component 1073 and an inductance component connected to the switch component can form a resonance circuit. When an inductance of the inductance component falls within a preset range, a resonance frequency of the resonance circuit covers a corresponding frequency band in the low-frequency bandwidth.

Optionally, a difference between a capacitance of the first capacitance component 1075 and an equivalent capacitance generated when the third switch component 1073 is in a disconnected state is less than or equal to a preset value.

A difference between a capacitance of the second capacitance component 1076 and an equivalent capacitance generated when the fourth switch component is in a disconnected state is less than or equal to a preset value.

The equivalent capacitance generated when the third switch component 1073 is in a disconnected state may be a capacitance of the parasitic capacitor in the third switch component 1073. The equivalent capacitance generated when the fourth switch component 1074 is in a disconnected state may be a capacitance of the parasitic capacitor in the fourth switch component 1074.

In an instance, the capacitance of the first capacitance component 1075 may be equal to or approximate to the capacitance, for example, 0.3 pF, of the parasitic capacitor in the third switch component 1073. The capacitance of the second capacitance component 1076 may be equal to or approximate to the capacitance, for example, 0.3 pF, of the parasitic capacitor in the fourth switch component 1074.

In FIG. 19, the third inductance component 1071 is connected to the first capacitance component 1075 in parallel, and the fourth inductance component 1072 is connected to the second capacitance component 1076 in parallel. In addition, the difference between the capacitance of the first capacitance component 1075 and the equivalent capacitance generated when the third switch component 1073 is in a disconnected state is less than or equal to the preset value, and the difference between the capacitance of the second capacitance component 1076 and the equivalent capacitance generated when the fourth switch component 1074 is in a disconnected state is less than or equal to the preset value. Therefore, a stopband may occur in a resonance frequency of a resonance circuit formed after the third inductance component 1071 is connected to the third switch component 1073 in series and a resonance frequency of a resonance circuit formed after the fourth inductance component 10721 is connected to the fourth switch component 1074 in series, and a passband location of the resonance frequency is lowered, thereby filtering out a spurious wave.

When a switch is disconnected, resonant impedance is formed on the third inductance component 1071 and the first capacitance component 1075 or the fourth inductance component 1072 and the second capacitance component on an original spurious-wave frequency band, and a small capacitance in low-frequency bandwidth and a large inductance in intermediate frequency bandwidth and high frequency bandwidth are presented, so that the frequency band is not affected. Therefore, frequency bands B4 in Long Term Evolution (Long Term Evolution, LTE) in a carrier aggregation (Carrier Aggregation, CA) state and a non-CA state have same performance. A capacitance presented in a low frequency in a switch disconnected state is less than a capacitance in a conventional filtering method, so that low-frequency bandwidth is correspondingly relatively narrow, thereby facilitating frequency tuning in a low-frequency bandwidth. The frequency bands B4 include a transmit frequency band from 1710 MHz to 1755 MHz and a receive frequency band from 2110 MHz to 2155 MHz.

In addition, referring to FIG. 17, it can be further learned that three switch states may enable return loss curves of B4 to be consistent. Referring to FIG. 18, it can be further learned that three switch states may further enable antenna efficiency of B4 to be consistent. Therefore, B4 performance in a CA state and a non-CA state does not deteriorate.

Figure 20:
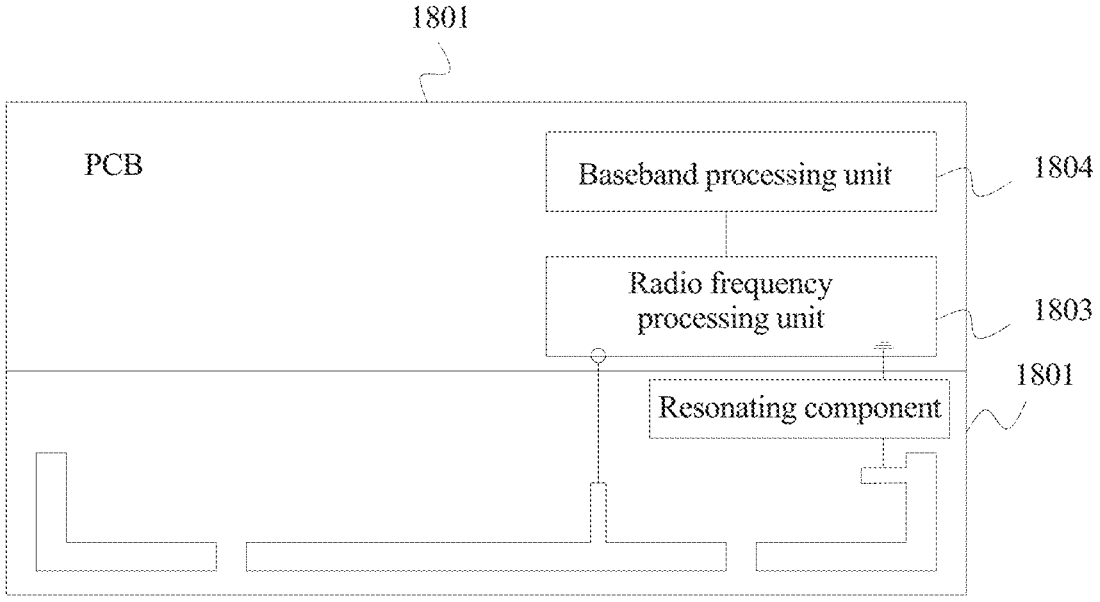
FIG. 20 is a schematic structural diagram of a terminal device according to an embodiment of this application.

An embodiment of this application further provides a terminal device. FIG. 20 is a schematic structural diagram of a terminal device according to an embodiment of this application. As shown in FIG. 20, the terminal device may include a PCB 2001 and an antenna 2002, The PCB 2001 includes a radio frequency processing unit 2003 and a baseband processing unit 2004. The antenna 2002 is the antenna described in any one of FIG. 1 to FIG. 19. Each radiation arm in the first radiating element in the antenna 2002 is connected to a feedpoint on the radio frequency processing unit 2003. The radio frequency processing unit 2003 is connected to the baseband processing unit 2004.

The antenna 2002 is configured to transmit a received radio signal to the radio frequency processing unit 1803, or send a transmit signal of the radio frequency processing unit 1803.

The radio frequency processing unit 2003 is configured to: after processing the radio signal received by the antenna 2002, send the radio signal to the baseband processing unit 2004; or after processing a signal sent by the baseband processing unit 2004, send the signal by using the antenna 2002.

The baseband processing unit 2004 is configured to process the signal sent by the radio frequency processing unit 2003.

The resonating structure is disposed in the antenna included in the terminal device provided in this embodiment of this application, so that in addition to a low-frequency bandwidth radiator included in the at least one radiation arm, the antenna may further include a low-frequency bandwidth radiator formed by the resonating structure. Therefore, even if one low-frequency bandwidth radiator is held in hand, another low-frequency bandwidth radiator may work, thereby effectively improving antenna efficiency in low-frequency bandwidth when the terminal device is held in hand, reducing antenna performance attenuation, and improving communication performance of the terminal device.

What is claimed is:

1. An antenna, comprising:

a metal frame comprising a slot configured to form a first radiating element and a second radiating element on the metal frame, wherein the second radiating element comprises a suspended radiation arm, and wherein the first radiating element comprises:

a longer radiation arm configured to couple to a feedpoint of a terminal device on which the antenna is located, and to extend away from the feedpoint in a first direction; and a shorter radiation arm configured to couple to the feedpoint, and to extend away from the feedpoint in a second direction; and a transfer switch coupled to the shorter radiation arm and to a ground of the terminal device; and a resonating structure configured to couple to the metal frame and comprising a resonating component configured to couple to the suspended radiation arm and to the ground, wherein the resonating component comprises:

a first inductance component; and a capacitance component coupled to the first inductance component, wherein the first inductance component and the capacitance component are configured to couple in series between the suspended radiation arm and the ground.

2. The antenna of claim 1, wherein:

the first inductance component is an adjustable inductance component, the capacitance component is an adjustable capacitance component, or the first inductance component is the adjustable inductance component and the capacitance component is the adjustable capacitance component.

3. The antenna of claim 1, wherein the resonating component comprises:

a second inductance component configured to couple to the suspended radiation arm;

a first switch configured to couple to the first inductance component and to the ground; and a second switch configured to couple to the second inductance component and to the ground.

4. The antenna of claim 1, wherein the transfer switch comprises:

a third inductance component configured to couple to the shorter radiation arm;

a fourth inductance component configured to couple to the shorter radiation arm, wherein the third inductance component and the fourth inductance component are configured in parallel;

a third switch coupled to the third inductance component and to the ground; and a fourth switch coupled to the fourth inductance component and to the ground.

5. The antenna of claim 4, wherein the third inductance component is further coupled in parallel to a first capacitance component coupled to the antenna, and wherein the fourth inductance component is further coupled to a second capacitance component in parallel.

6. The antenna of claim 5, wherein a difference between a first capacitance of the first capacitance component and a second capacitance generated when the third switch is disconnected is less than or equal to a first preset value, and wherein a difference between a third capacitance of the second capacitance component and a fourth capacitance generated when the fourth switch is disconnected is less than or equal to a second preset value.

7. The antenna of claim 1, wherein the slot is a PI-shaped slot or a U-shaped slot.

8. A terminal device, comprising:

a printed circuit board (PCB) comprising:

a baseband processor configured to process a radio signal; and a radio frequency processor coupled to the baseband processor and configured to transmit the radio signal, an antenna coupled to the PCB and configured to transmit the radio signal sent from the radio frequency processor, wherein the antenna comprises:

a metal frame provided with a slot configured to form a first radiating element and a second radiating element on the metal frame, wherein the second radiating element comprises a suspended radiation arm, and wherein the first radiating element comprises:

a longer radiation arm coupled to a feedpoint of the terminal device on which the antenna is located and to a feedpoint of the radio frequency processor, wherein the longer radiation arm extends away from the feedpoints in a first direction;

a shorter radiation arm coupled to the feedpoint of the terminal device and to the feedpoint of the radio frequency processor, wherein the shorter radiation arm extends away from the feedpoints in a second direction; and a transfer switch coupled to the shorter radiation arm and to a ground of the terminal device; and a resonating structure, coupled to the metal frame and comprising a resonating component coupled to the suspended radiation arm and to the ground, wherein the resonating component comprises:

a first inductance component; and a capacitance component coupled to the first inductance component, wherein the first inductance component and the capacitance component are configured to couple in series between the suspended radiation arm and the ground.

9. The terminal device of claim 8, wherein the first inductance component is an adjustable inductance component, the capacitance component is an adjustable capacitance component, or the first inductance component is the adjustable inductance component, and the capacitance component is the adjustable capacitance component.

10. The terminal device of claim 8, wherein the resonating component comprises:

a second inductance component coupled to the suspended radiation arm;

a first switch coupled to the first inductance component and to the ground; and a second switch coupled to the second inductance component and to the ground.

11. The terminal device of claim 8, wherein the transfer switch comprises:

a third inductance component coupled to the shorter radiation arm;

a fourth inductance component coupled to the shorter radiation arm, wherein the third inductance component and the fourth inductance component are coupled in parallel;

a third switch coupled to the third inductance component and to the ground; and a fourth switch coupled to the fourth inductance component and to the ground.

12. The terminal device of claim 11, wherein the third inductance component is further coupled in parallel to a first capacitance component, and wherein the fourth inductance component is further coupled to a second capacitance component in parallel.

13. The terminal device of claim 12, wherein a difference between a first capacitance of the first capacitance component and a second capacitance generated, when the third switch is disconnected, is less than or equal to a first preset value and the difference between a third capacitance of the second capacitance component and a fourth capacitance generated, when the fourth switch is disconnected, is less than or equal to a second preset value.

14. The terminal device of claim 8, wherein the slot is a PI-shaped slot or a U-shaped slot.

15. An antenna, comprising:

a metal frame comprising a slot configured to form a first radiating element and a second radiating element on the metal frame, wherein the second radiating element comprises a suspended radiation arm, and wherein the first radiating element comprises:

a longer radiation arm configured to couple to a feedpoint of a terminal device on which the antenna is located, and to extend away from the feedpoint in a first direction;

a shorter radiation arm configured to couple to the feedpoint, and to extend away from the feedpoint in a second direction; and a transfer switch coupled to the shorter radiation arm and to a ground of the terminal device; and a resonating structure configured to couple to the metal frame and comprising a resonating component configured to couple to the suspended radiation arm and to the ground, wherein the resonating component comprises:

a first inductance component coupled to the suspended radiation arm;

a second inductance component coupled to the suspended radiation arm;

a first switch coupled to the first inductance component and to the ground; and a second switch coupled to the second inductance component and to the ground.

16. The antenna of claim 15, wherein:

the first inductance component is an adjustable inductance component, the second inductance component is an adjustable inductance component, or the first and second inductance components are adjustable inductance components.

17. The antenna of claim 15, wherein the transfer switch comprises:

a third inductance component configured to couple to the shorter radiation arm;

a fourth inductance component configured to couple to the shorter radiation arm, wherein the third inductance component and the fourth inductance component are configured in parallel;

a third switch coupled to the third inductance component and to the ground; and a fourth switch coupled to the fourth inductance component and to the ground.

18. The antenna of claim 17, wherein the third inductance component is further coupled in parallel to a first capacitance component coupled to the antenna, and wherein the fourth inductance component is further coupled to a second capacitance component in parallel.

19. The antenna of claim 18, wherein a difference between a first capacitance of the first capacitance component and a second capacitance generated when the third switch is disconnected is less than or equal to a first preset value, and wherein a difference between a third capacitance of the second capacitance component and a fourth capacitance generated when the fourth switch is disconnected is less than or equal to a second preset value.

20. The antenna of claim 15, wherein the slot is a PI-shaped slot or a U-shaped slot.

* * * * *